US008341952B2

(12) United States Patent
Diez et al.

(10) Patent No.: US 8,341,952 B2
(45) Date of Patent: Jan. 1, 2013

(54) EXHAUST MANIFOLD

(75) Inventors: Rainer Diez, Nagold (DE); Frank Buehler, Moetziugen (DE); Markus Mackert, Altensteig (DE); Nils Rippert, Gross-Umstadt (DE)

(73) Assignee: Friedrich Boysen GmbH & Co. KG, Altensteig (DE)

( * ) Notice: Subject to any disclaimer, the term of this patent is extended or adjusted under 35 U.S.C. 154(b) by 334 days.

(21) Appl. No.: 12/590,287

(22) Filed: Nov. 4, 2009

(65) Prior Publication Data

US 2010/0126156 A1 May 27, 2010

(30) Foreign Application Priority Data

Nov. 10, 2008 (DE) ..... 10 2008 056 654
Apr. 20, 2009 (DE) ..... 10 2009 018 104

(51) Int. Cl.
*F01N 3/02* (2006.01)

(52) U.S. Cl. ..... 60/323; 60/324

(58) Field of Classification Search ..... 60/321, 60/324

See application file for complete search history.

(56) References Cited

U.S. PATENT DOCUMENTS

| | | | | |
|---|---|---|---|---|
| 4,833,882 | A | 5/1989 | Yasuda et al. | |
| 6,487,854 | B2 * | 12/2002 | Maus | 60/323 |
| 6,555,070 | B1 * | 4/2003 | Kruger | 60/323 |
| 7,578,124 | B2 * | 8/2009 | Diez et al. | 60/323 |
| 2004/0226291 | A1 | 11/2004 | Diez et al. | |
| 2007/0084200 | A1 | 4/2007 | Saito | |

FOREIGN PATENT DOCUMENTS

| | | | |
|---|---|---|---|
| DE | 35 28 136 | A1 | 8/1985 |
| DE | 39 25 802 | A1 | 8/1989 |
| DE | 43 05 886 | A1 | 9/1994 |
| DE | 199 05 032 | A1 | 2/1999 |
| DE | 203 03 759 | U1 | 3/2003 |
| DE | 103 57 081 | A1 | 12/2003 |
| DE | 20 2006 015 883 | U1 | 10/2006 |
| EP | 1 359 294 | A1 | 11/2003 |
| FR | 2 849 469 | A1 | 7/2004 |

* cited by examiner

*Primary Examiner* — Thomas Denion
*Assistant Examiner* — Diem Tran
(74) *Attorney, Agent, or Firm* — Kilpatrick Townsend & Stockton LLP

(57) ABSTRACT

An exhaust gas system includes an exhaust manifold, in particular a single-wall exhaust manifold, which includes a plurality of inlet pipes for connection to exhaust gas outlets of an internal combustion engine and a collector device for the combining of the inlet pipes. The collector device has an outlet opening which is connected to downstream elements of the exhaust gas system, wherein the collector device is resistant to bending and the inlet pipes are comparatively flexible with respect to the collector device. The collector device includes an inlet pipe stub which is likewise resistant to bending and which is made for the direct connection to an exhaust gas outlet of an internal combustion engine.

15 Claims, 2 Drawing Sheets

EXHAUST MANIFOLD

CROSS-REFERENCES TO RELATED APPLICATIONS

This application claims priority to German patent application No. 10 2008 056 654.3, filed on Nov. 10, 2008 and German patent application No. 10 2009 018 104.0, filed Apr. 20, 2009, the disclosures of which are incorporated herein by reference.

BACKGROUND OF THE INVENTION

The present invention relates to an exhaust gas system having an exhaust manifold, in particular a single-wall exhaust manifold, which includes a plurality of inlet pipes for connection to exhaust gas outlets of an internal combustion engine and a collector device for the combining of the inlet pipes, with the collector device having an outlet opening which is connected to downstream elements of the exhaust gas system, with the collector device being resistant to bending and the inlet pipes being comparatively flexible with respect to the collector device.

BRIEF SUMMARY OF THE INVENTION

It is the underlying object of the invention to improve an exhaust gas system of the named kind with respect to manufacturing costs and weight.

This object is satisfied in that the collector device includes an inlet pipe stub which is likewise resistant to bending and which is made for direct connection to an exhaust gas outlet of an internal combustion engine.

This stub serves as a bearing element for the collector device and for the total exhaust manifold, which can naturally additionally have further bearing elements, due to the connection of the inlet pipe stub resistant to bending to the exhaust gas outlet of an internal combustion engine. A separate support or connection of the exhaust manifold can thereby be saved. Both the weight of the exhaust manifold and its manufacturing costs are thereby reduced.

The collector device with the inlet pipe stub resistant to bending thus takes over the bearing function, whereas the inlet pipes more flexible with respect thereto serve, in addition to their sealing function, for the compensation of different extents due to temperature changes.

The inlet pipe stub can in particular be integral at the collector device. The collector device is preferably made of material resistant to bending. The resistance to bending can also be achieved, in addition to the selection of the material, by the thickness of the material or by the cross-sectional shape of the collector device. The collector device thus forms a self-supporting component for integration into the exhaust gas system.

The inlet pipes can be made of material comparatively flexible with respect to the collector device. The relatively high resistance to bending of the inlet pipes can, however, also be achieved, in addition to the selection of the material, by the thickness of the material and/or the cross-sectional shape of the pipes. The inlet pipes can thereby preferably be made without a decoupling element or compensation element. The pipes can also be made of different materials to one another or have different wall thicknesses depending on how high the respective load by heat expansion of the respective pipe is. A longer pipe can thus be formed with a larger wall thickness or it can be made from a high-strength material, while shorter pipes can be made of thinner material or of more cost-effective, simply strong material.

The collector device can in particular be made as a one-piece collector housing and it can be connected in different manners to downstream parts of an exhaust gas system, for example by welding, screwing, soldering, by means of a V clip or a flat band clip.

The collector device can in particular be made as a cast part. It is also possible to form the collector device as an internal high-pressure forming part with a large wall thickness. The inlet pipes are, in contrast, preferably made as sheet metal parts or as fabricated pipes.

In accordance with an embodiment, the collector device is connected to a turbocharger and/or to a catalytic converter close to the engine. The collector device can in particular be made for connection to a monoscroll or a twin-scroll turbocharger. The collector device is provided with a separating wall up to the outlet opening for a twin-scroll charger. A prior union is provided for a monoscroll charger, that is the separating wall is in particular omitted. The exhaust gas routing is in another respect preferably separated so that the exhaust manifold is made is an ignition sequence manifold in which exhaust gas outlets are combined with an ignition sequence interval which is as large as possible.

The collector device can form at least one part of a downstream turbine housing of a turbocharger. Further costs and components can thereby be saved. The collector device can furthermore have a mount, in particular an integral mount, for a lambda probe. Equally, further moldings can be provided at the collector device via which components can be fastened, for example, screen surfaces for heat shielding of surrounding components.

In accordance with an embodiment, the inlet pipes and the pipe stubs of the collector device are connected to one or more engine flanges. The engine flanges can be sheet metal flanges to which the collector device is connected at sides of the exhaust gas inlets. This is advantageous from the aspect of manufacturing costs and of weight.

The weld connections, in particular between the inlet pipes and the engine flange as well as between the inlet pipes and the collector device are preferably made so that the welding takes place from the outside. Weld splashes in the interior of the exhaust manifold can thereby be avoided.

The exhaust manifold in accordance with the invention can be used, for example, for a four-cylinder engine. The motor flange can in this respect be made in split form. Heat expansion can thereby be reduced.

The wall thickness of the inlet pipes preferably amounts to at most approximately 1.2 mm. The wall thickness of the collector device preferably amounts to at least approximately 1.5 mm, in particular to between approximately 2 mm and approximately 3 mm.

The invention will be described in the following with reference to an embodiment and to the drawings.

DETAILED DESCRIPTION OF THE INVENTION

Figure 1:
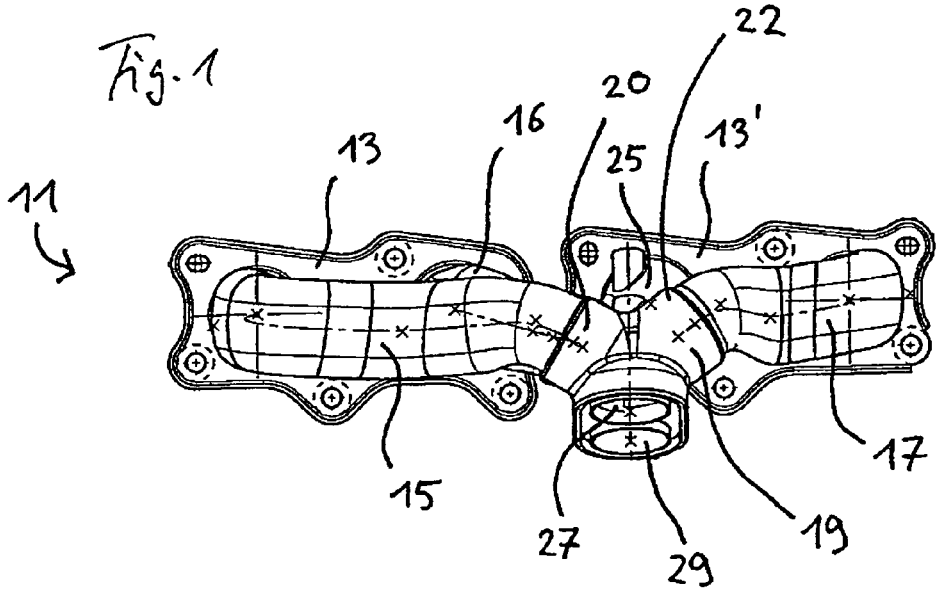
FIG. 1 shows a plan view of an exhaust manifold of an exhaust gas system in accordance with the invention.
Figure 2:
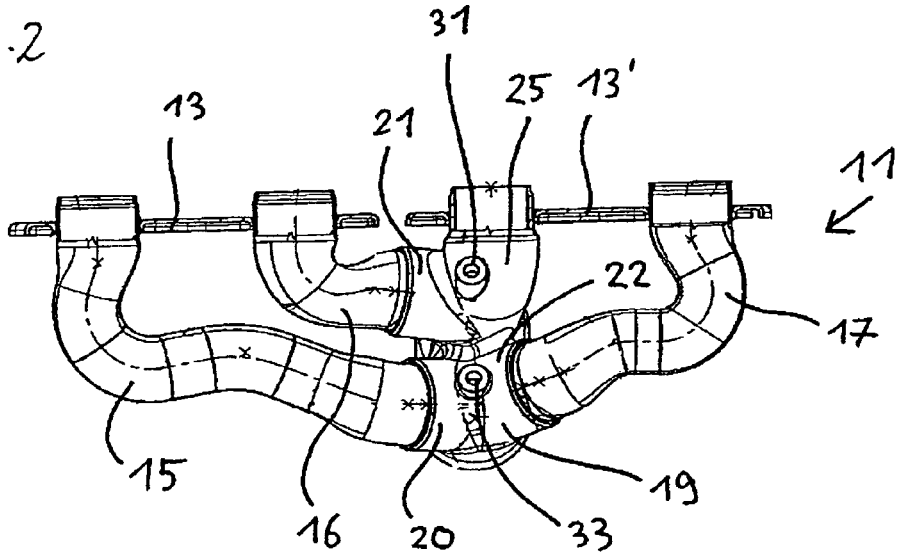
FIG. 2 shows a plan view of the exhaust manifold of FIG. 1 rotated by 90°.
Figure 3:
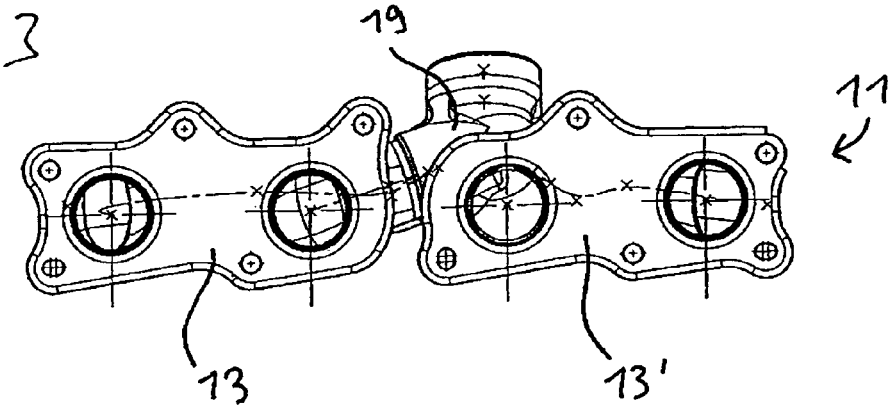
FIG. 3 shows a plan view of the exhaust manifold of FIG. 1 rotated by a further 90°.
Figure 4A:
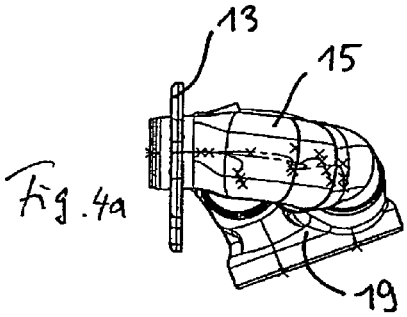
FIG. 4*a* shows a side view of the exhaust manifold of FIG. 1.
Figure 4B:
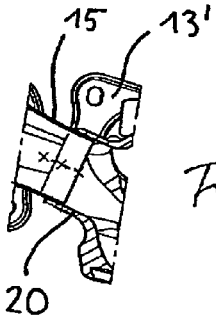
FIG. 4*b* shows a partial plan view of the exhaust manifold of FIG. 1 in a sectional representation.
Figure 5:
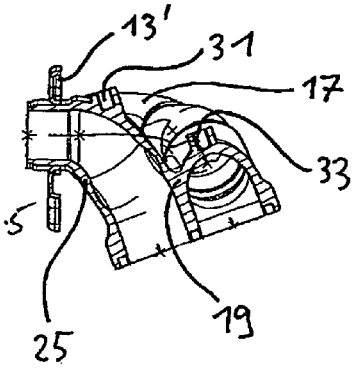
FIG. 5 shows a partial side view of the exhaust manifold of FIG. 1 in a sectional representation.
Figure 6:
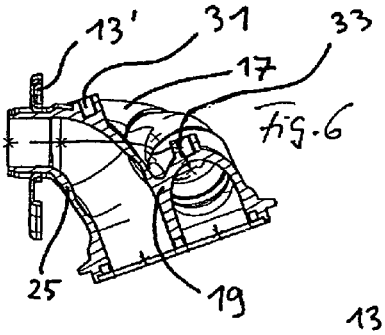
FIG. 6 shows a further partial sectional representation of the exhaust manifold of FIG. 1.
Figure 8:
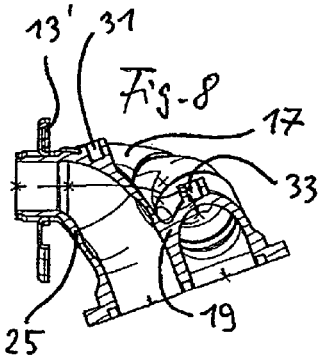
FIG. 8 shows a further partial sectional representation of the exhaust manifold of FIG. 1.
Figure 7:
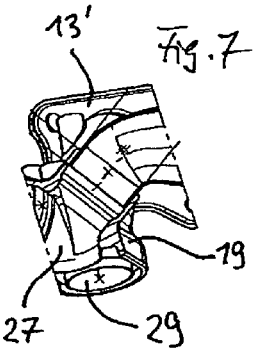
FIG. 7 shows a further partial sectional representation of the exhaust manifold of FIG. 1.
Figure 9:
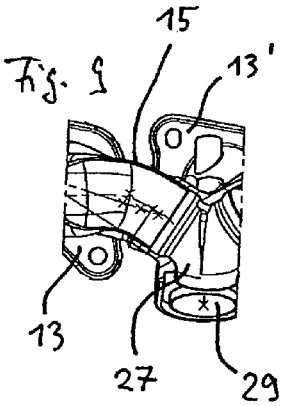
FIG. 9 shows a further partial sectional representation of the exhaust manifold of FIG. 1.
Figure 10:
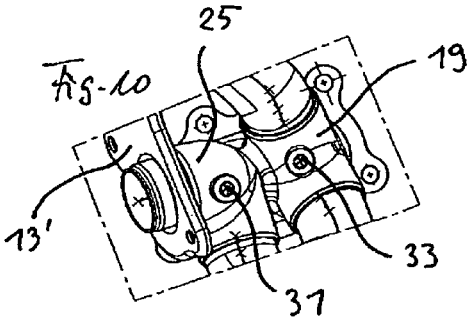
FIG. 10 shows a perspective partial view of the exhaust manifold of FIG. 1.

A four-pipe, single-wall exhaust manifold 11 is shown in the Figures which forms a part of an exhaust gas system for a four-cylinder combustion engine. The exhaust manifold 11 is connected at the inlet side to a split engine flange 13, 13' and at the outlet side to a turbocharger, not shown. Three inlet pipes 15, 16, 17 are provided at the exhaust manifold 11 which are made of comparatively flexible material and are received at the exhaust gas side in an opening of the associated engine flange 13, 13'. At the exhaust outlet side, the inlet pipes 15, 16, 17 are connected to a collector housing 19. The collector housing 19 is made as a cast part resistant to bending and has walls into which connection stubs 20, 21, 22 are formed for the reception of the inlet pipes 15, 16, 17.

An inlet pipe stub 25 which is received at the exhaust inlet side in an opening of the engine flange 13, 13' is furthermore integral at the collector housing 19. The combustion engine has four exhaust gas outlets. Three of the exhaust gas outlets each open into one of the inlet pipes 15, 16, 17, whereas an exhaust gas outlet opens into the inlet pipe stub 25. The collector housing 19 defines a first collector space 27 in which the exhaust gas flows from two of the inlet pipes 15, 16, 17 are conducted and a second collector space 29 into which the exhaust gas flows from the remaining one of the inlet pipes 15, 16, 17 as well as from the inlet stub 25 are conducted. The collector housing 19 furthermore has two recesses 31, 33 into which a lambda probe, not shown for improved simplicity, is respectively inserted. The collector spaces 27, 29 are made such that each lambda probe is flown against by the exhaust gas flow of two exhaust gas outlets.

The inlet pipes 15, 16, 17 are each welded to the engine flange 13, 13' as well as to one of the connection stubs 20, 21, 22. The inlet pipe stub 25 is likewise welded to the engine flange 13, 13'. A length compensation which becomes necessary on heating can take place via the inlet pipes 15, 16, 17. They are namely fabricated pipes which have a relatively high flexibility or deformability. There is a direct connection between the engine flange 13, 13' and the collector housing 19 resistant to bending via the inlet pipe stub 25 made in one piece with the collector housing 19 so that a high strength of the manifold structure is achieved despite the flexible inlet tubes 15, 16, 17. There is in particular a connection between the combustion engine and the turbine housing of the turbocharger which is based only on comparatively shape-stable structures resistant to bending. The exhaust manifold 11 thus also forms a self-supporting component for which no separate support elements are required at high temperatures. The collector housing 19 and the inlet pipes 15, 16 17 can each be manufactured relatively simply and with relatively high precision so that the exhaust manifold 11 is cost-effective in manufacture.

The invention claimed is:

1. An exhaust gas system having an exhaust manifold (11), which includes a plurality of inlet pipes (15, 16, 17) for connection to exhaust gas outlets of an internal combustion engine and a collector device (19) for the combining of the inlet pipes (15, 16, 17), wherein the collector device (19) has an outlet opening which is connected to downstream elements of the exhaust gas system, wherein the collector device (19) is resistant to bending and the inlet pipes (15, 16, 17) are comparatively flexible with respect to the collector device (19), characterized in that the exhaust manifold (11) is a single-wall exhaust manifold (11); and the collector device (19) includes an inlet pipe stub (25) which is likewise resistant to bending and which is made for the direct connection to an exhaust gas outlet of an internal combustion engine.

2. An exhaust gas system in accordance with claim 1, characterized in that the inlet pipe stub (25) is integral at the collector device (19).

3. An exhaust gas system in accordance with claim 1, characterized in that the collector device (19) is made of material resistant to bending.

4. An exhaust gas system in accordance with claim 1, characterized in that the inlet pipes (15, 16, 17) are made of material comparatively flexible with respect to the collector device (19).

5. An exhaust gas system in accordance with claim 1, characterized in that the collector device (19) is made as a one-piece collector housing.

6. An exhaust gas system in accordance with claim 1, characterized in that the collector device (19) is made as a cast part.

7. An exhaust gas system in accordance with claim 1, characterized in that the collector device (19) is made as an internal high-pressure forming part with a large wall thickness.

8. An exhaust gas system in accordance with claim 1, characterized in that the inlet pipes (15, 16, 17) are made as sheet metal parts.

9. An exhaust gas system in accordance with claim 1, characterized in that the collector device (19) is connected to at least one of a turbocharger and to a catalytic converter close to the engine.

10. An exhaust gas system in accordance with claim 9, characterized in that the collector device (19) forms at least a part of a downstream turbine housing of a turbocharger.

11. An exhaust gas system in accordance with claim 1, characterized in that the collector device (19) has a mount (31, 33), in particular an integral mount, for a lambda probe.

12. An exhaust gas system in accordance with claim 1, characterized in that the single-wall exhaust manifold (11) is made as an ignition sequence manifold.

13. An exhaust gas system in accordance with claim 1, characterized in that the inlet pipes (15, 16, 17) and the pipe stub (25) of the collector device (19) are connected to one or more engine flanges (13, 13').

14. An exhaust gas system in accordance with claim 1, characterized in that the wall thickness of the inlet pipes (15, 16, 17) amounts to at most 1.2 mm.

15. An exhaust gas system in accordance with claim 1, characterized in that the wall thickness of the collector device (19) amounts to at least 1.5 mm, in particular to between approximately 2 mm and approximately 3 mm.

* * * * *